United States Patent [19]

Giehl

[11] Patent Number: 4,702,271

[45] Date of Patent: Oct. 27, 1987

[54] FLOW-CONTROL DEVICE

[75] Inventor: Klaus-Ulrich Giehl, Heimborn, Fed. Rep. of Germany

[73] Assignee: Lothar Steinhardt, Taunusstein, Fed. Rep. of Germany

[21] Appl. No.: 913,013

[22] Filed: Sep. 29, 1986

[30] Foreign Application Priority Data

Oct. 2, 1985 [DE] Fed. Rep. of Germany ..... 3535163

[51] Int. Cl.[4] ..... F16K 31/18; F16K 33/00

[52] U.S. Cl. ..... 137/389; 137/390; 137/398; 137/426; 137/448; 137/554; 251/208

[58] Field of Search ..... 137/101.25, 101.27, 137/389, 390, 395, 397, 398, 399, 434, 446, 448, 426, 554; 251/208, 294, 14, 205

[56] References Cited

U.S. PATENT DOCUMENTS

| | | | |
|---|---|---|---|
| 398,778 | 2/1889 | Gunckel | 137/390 |
| 1,035,999 | 8/1912 | Paterson | 137/398 |
| 1,190,958 | 7/1916 | Selden | 137/398 |
| 1,575,094 | 3/1926 | Bright | 137/398 |
| 1,904,793 | 4/1933 | Lavoie | 137/390 |
| 2,247,532 | 7/1941 | Tripp | 137/389 |
| 2,882,919 | 4/1959 | Brown | 137/101.27 |
| 3,381,706 | 5/1968 | Hendey | 137/398 |
| 4,381,100 | 4/1983 | Schoenberg | 137/554 |
| 4,582,083 | 4/1986 | Steinhardt | 137/446 |

FOREIGN PATENT DOCUMENTS

| | | | |
|---|---|---|---|
| 2523942 | 12/1976 | Fed. Rep. of Germany | 137/398 |
| 3007035 | 12/1982 | Fed. Rep. of Germany | 137/398 |
| 848512 | 10/1939 | France | 137/398 |

*Primary Examiner*—George L. Walton
*Attorney, Agent, or Firm*—Max Fogiel

[57] ABSTRACT

The invention concerns a float-controlled flow-control devie for the outlet from a sewage system, especially a rain basin. The bearings for the pivots (7 & 8) that the float arm (4) and the shutter (2) rotate on are mounted on a displaceable structure (3). This makes it possible to vary the outflow volume to be controlled even when the device is in operation, and hence to control it remotely as well.

6 Claims, 3 Drawing Figures

FLOW-CONTROL DEVICE

Figure 1:
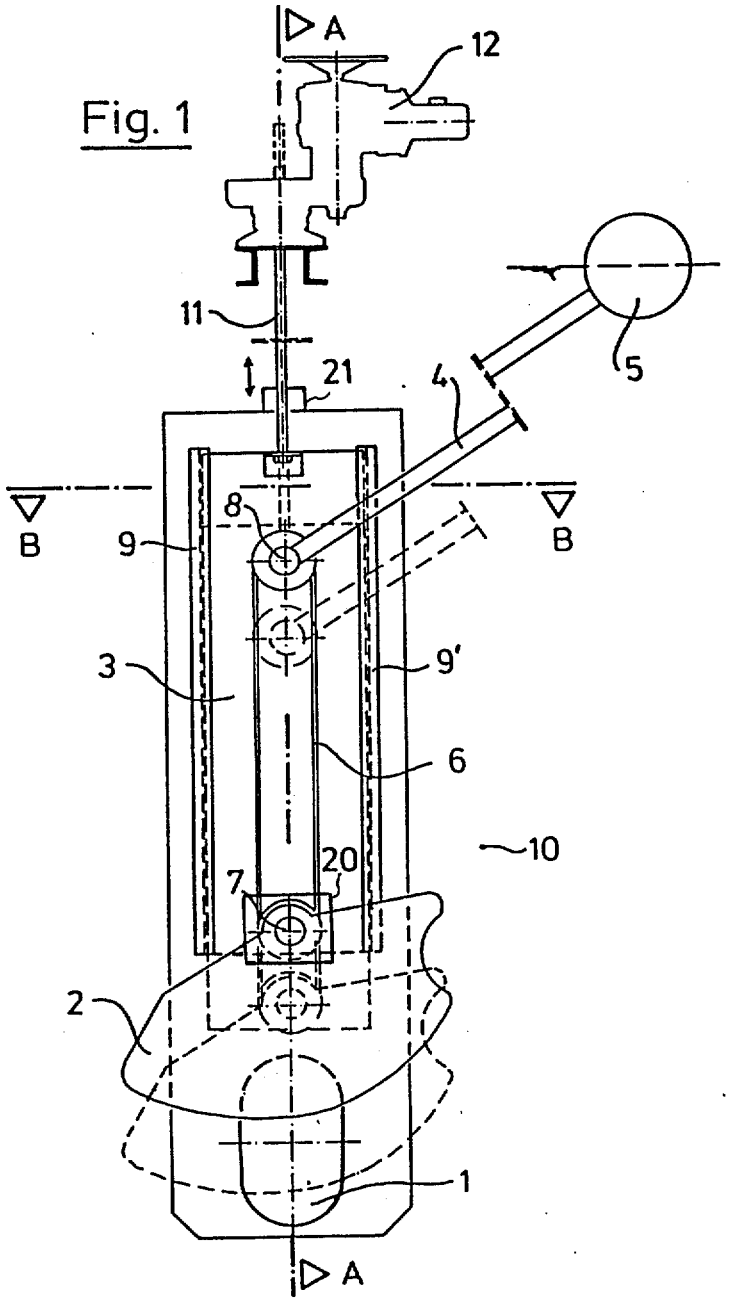

The invention concerns a flow-control device for the outlet from a sewage system, especially a rain basin.

A flow-control device in the art is known from German OS No. 3 007 035.

The bearings for the pivots that the float arm and the flow-control shutter rotate on are secured to the wall of the basin at prescribed distance from the axis of the outlet. The drawback of this known device is that it is impossible to vary the distance (from the pivots to the outlet) and hence the outflow curve when the device is in operation.

There exist, however, large drainage systems with a large number of rain basins that, due to the large size of the catchment area, are subjected to irregularly distributed precipitation. It would accordingly be desirable in relation to protection against flooding to be able to withdraw more effluent from basins in the section of the catchment area with more precipitation and less from those where the precipitation was less or non-existent, so that the maximum access to the treatment plant could be optimally exploited. This is impossible with the known flow-control device.

Another drawback is that the volume of effluent traveling through the flow-control device cannot be adjusted to the expansion stage of the sewer network. Furthermore, the known flow-control device cannot be remotely operated.

The object of the invention is to improve a flow-control device of the known type to the extent that the setting of the shutter can be adjusted even during operation.

This object is attained by means of the characteristics of the body of claim 1.

The position of the moving structure can accordingly be varied manually or by means of a servomotor through the intermediary of a shaft or rod.

This results in a number of advantages. An optimum outflow can be set in an extensive sewage system with several basins as a function of the particular operating state of each basin (with, that is, some of them full, others partly full, and others empty). If it is desirable to adjust the outflow remotely instead of manually where electricity is available, the level of water in the basin can be displayed as a function of the angle of one of the pivots and hence of the height of the float by means of an electric contact on the pivot. Thus, an additional water-level meter will be unnecessary.

The outflow volume itself can also be displayed as a function of the position of the moving structure by means of an electric contact mounted on the wall of the basin for instance.

The advantage of this solution over controls that are operated only with external power is that the actual control process is not interrupted during power failure or other malfunctions in the electric circuitry.

If the device gets clogged, the moving structure can be raised to increase the cross-section of the outlet while the obstruction is removed. It will accordingly be unnecessary to empty the basin in emergencies.

The outflow volume that is to be controlled can be adapted to the expansion stage of the sewer network.

Figure 2:
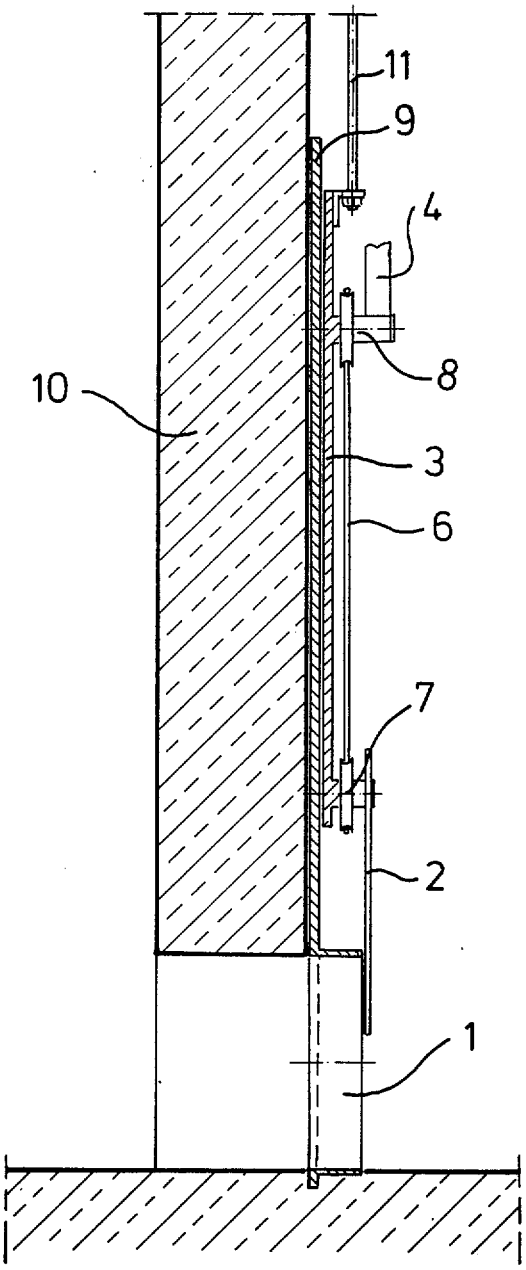
Figure 3:
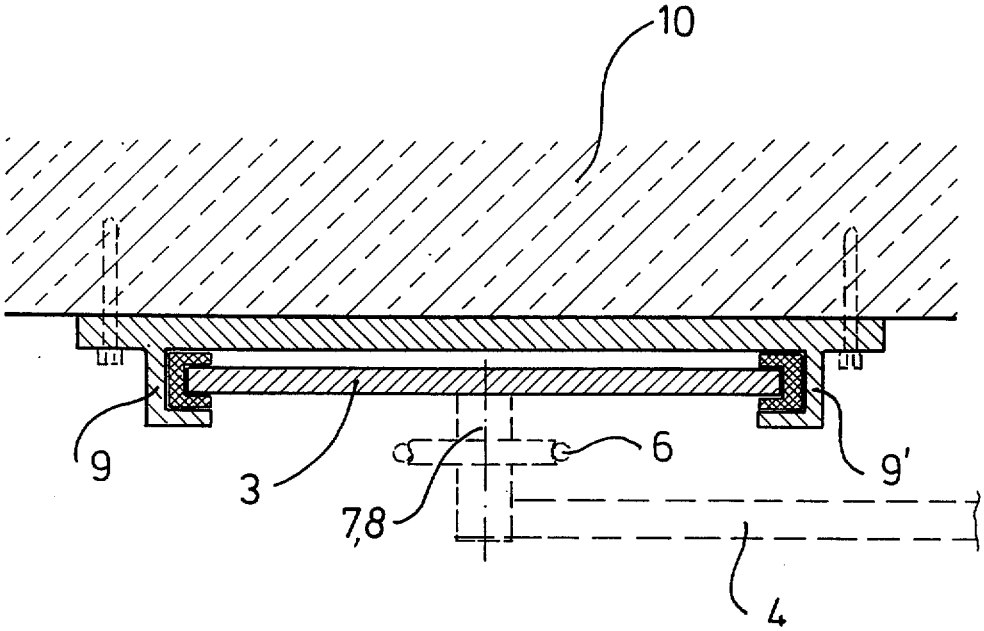

An embodiment of the invention will now be specified with references to FIGS. 1 through 3, wherein FIG. 1 is a front view of a device in accordance with the invention, FIG. 2 is a section along the line A—A in FIG. 1, and FIG. 3 is a section along the line B—B in FIG. 1.

As will be evident from FIGS. 1 and 2, the device in accordance with the invention consists essentially of an outlet 1, of a shutter 2 that rotates on a pivot 7, of a moving structure 3, of a float 5 mounted on a float arm 4 that rotates on a pivot 8, and of a transmission 6 between float 5 and shutter 2.

The view in FIG. 1 illustrates the device in operation, with the solid lines indicating moving structure 3 in its upper position and the broken lines the structure in its lower position.

The bearings for pivots 7 and 8 are rigidly secured to moving structure 3.

The moving structure 3 in the embodiment in question slides back and forth in guiderails 9 and 9' rigidly secured to the wall 10 of the basin.

Moving structure 3 is positioned or displaced by a rod 11 that can be activated either manually or by means of a servomotor 12.

When moving structure 3 is raised, the cross-section of outlet 1 increase to a prescribed extent and, when the structure is lowered, the cross-section is decreased to a prescribed extent. The shapes of outlet 1 and of shutter 2 are designed in relation to each other to provide different outflow curves at various water levels.

An electric contact 20 may be mounted on one of the pivots, such as pivot 7 for example, and the pivoting angle can be displayed by the contact.

An electric contact 21 may also be mounted on the shaft or rod 11, and the position of the moving structure 3 can be displayed by this contact.

I claim:

1. A flow control device for a sewage system, particularly a rain basin, comprising: a sewage system with an outlet; at least one shutter element mounted rotatably on a first pivot perpendicular to said outlet; a float arm mounted rotatably on a second pivot; transmission means connecting said shutter element to said float arm, said outlet being blocked to a predetermined extent by said shutter element when said float is at a maximum height, blockage of said outlet being reduced when said float is lower than said maximum height; a common movable member carrying said first and second pivots, said first and second pivots being displaced together with movement of said common member and being held on position by said common member at a selected maximum water level; and guide means for guiding securely the movement of said common member, variation in position of said common member independent of said float movement for varying flow characteristics steplessly from said outlet during normal operation of said control device by said shutter element through a fixed relationship between said pivots and said common member, so that different outflow curves are obtained at different water levels sensed by said float.

2. A flow control device as defined in claim 1, wherein said common movable member is positioned manually.

3. A flow control device as defined in claim 1, including servomotor means connected to said common movable member through intermediate linkage means for positioning said common movable member.

4. A flow control device as defined in claim 1, including electrical contact means mounted on one of said pivots for displaying pivoting angle.

5. A flow control device as defined in claim 1, including linkage means connected to said common movable member; and electrical contact means mounted on said linkage means for displaying position of said common movable member by said contact means.

6. A flow control device as defined in claim 3, wherein said servomotor is remote-controlled.

* * * * *